US008960509B2

(12) United States Patent
Rathbun

(10) Patent No.: US 8,960,509 B2
(45) Date of Patent: Feb. 24, 2015

(54) COMBINATION BACKPACK AND CLOTHING HOLDER

(76) Inventor: Jonathan M. Rathbun, Belmont, MI (US)

( * ) Notice: Subject to any disclaimer, the term of this patent is extended or adjusted under 35 U.S.C. 154(b) by 333 days.

(21) Appl. No.: 13/449,832

(22) Filed: Apr. 18, 2012

(65) Prior Publication Data

US 2012/0267411 A1 Oct. 25, 2012

Related U.S. Application Data

(60) Provisional application No. 61/476,804, filed on Apr. 19, 2011.

(51) Int. Cl.
*A45F 3/04* (2006.01)

(52) U.S. Cl.
USPC ..... 224/153; 224/650; 224/652; 224/154; 224/155

(58) Field of Classification Search
CPC . A45F 3/04; A45F 2004/006; A45F 2004/02; A45F 4/04
USPC ..... 224/153–155, 650, 652, 653
See application file for complete search history.

(56) References Cited

U.S. PATENT DOCUMENTS

| | | | |
|---|---|---|---|
| 3,206,087 | A | 10/1961 | Tyrrell |
| 4,087,031 | A | 5/1978 | Fenner |
| D320,501 | S | 10/1991 | Marks |
| D371,677 | S | 7/1996 | Cantwell et al. |
| D381,704 | S | 7/1997 | Li |
| D385,688 | S | 11/1997 | Clausell |
| D386,300 | S | 11/1997 | Kopel |
| 5,785,219 | A | 7/1998 | Kraft |
| 5,850,634 | A | 12/1998 | Toombs |
| D403,836 | S | 1/1999 | Len |
| D404,539 | S | 1/1999 | Glasser |
| D432,298 | S | 10/2000 | Markowitz |
| D450,448 | S | 11/2001 | Pierce et al. |
| D451,274 | S | 12/2001 | Kegels |
| D470,655 | S | 2/2003 | Smith |
| 6,786,375 | B2 | 9/2004 | Worden et al. |
| D498,585 | S | 11/2004 | Darling |
| D509,653 | S | 9/2005 | Yu |
| D631,245 | S | 1/2011 | Sabbah |
| D649,782 | S | 12/2011 | Chen et al. |
| D652,207 | S | 1/2012 | Hedaya |
| D661,092 | S | 6/2012 | Chen et al. |
| D661,481 | S | 6/2012 | Hedaya |
| D669,257 | S | 10/2012 | Hedaya |
| 8,292,136 | B2 | 10/2012 | Tonelli |

(Continued)

*Primary Examiner* — Brian D Nash
(74) *Attorney, Agent, or Firm* — Gardner, Linn, Burkhart & Flory, LLP

(57) ABSTRACT

A combination backpack and clothing holder allows for the organized storage and drying of individual clothing articles. The clothing holder is configurable between a stored state in which it is folded compactly when not in use, and a use state in which the clothing holder portion is unfolded or opened or deployed to store articles of clothing and to promote drying and access to the clothing articles. Optionally, the clothing holder portion may be generally in the shape of a body, including hand/arm portions and leg/foot portions, which facilitate organizing of clothing articles into corresponding compartments of the clothing holder according to how the articles are normally worn. Optionally, the clothing holder may be configured in a stored-use or transport state in which the articles are securely stored in a folded configuration while a backpack portion of the combination backpack and clothing holder is being worn.

22 Claims, 18 Drawing Sheets

(56) References Cited

U.S. PATENT DOCUMENTS

| | | | |
|---|---|---|---|
| D674,183 | S | 1/2013 | Iacchetti |
| 2009/0180715 | A1 | 7/2009 | Wittke-Kothe |
| 2010/0078457 | A1 | 4/2010 | Pitchford |
| 2011/0297719 | A1 | 12/2011 | Sabbah |
| 2011/0309122 | A1 | 12/2011 | Sternlight et al. |
| 2012/0244768 | A1 | 9/2012 | Oehlert et al. |

COMBINATION BACKPACK AND CLOTHING HOLDER

CROSS REFERENCE TO RELATED APPLICATION

The present application claims the filing benefit of U.S. provisional application Ser. No. 61/476,804, filed Apr. 19, 2011, which is hereby incorporated herein by reference in its entirety.

FIELD OF THE INVENTION

The present invention relates generally to backpacks, and more particularly to backpacks for school.

BACKGROUND OF THE INVENTION

Backpacks are commonly worn by schoolchildren and used for carrying books, papers, lunch containers, and the like. In many classrooms, particularly in classrooms for elementary-age schoolchildren in cold weather climates, children may arrive at school or at home wearing outerwear (such as gloves or mittens, boots, jackets, hats, snow pants and/or the like) that have become wet and/or muddy, such that it is appropriate to store the soiled or wet articles of outerwear clothing in a manner that they can dry out prior to reuse. However, schoolchildren, and particularly younger schoolchildren, are prone to misplacing articles of outerwear. One child's clothing can readily become mixed up or buried in other children's clothing, particularly when many children are removing and storing their outerwear in a single location, such as in elementary school classrooms or coat rooms for drying during class.

SUMMARY OF THE INVENTION

The present invention provides a combination backpack and clothing holder that allows a wearer to store "normal" articles (such as academic articles such as books, papers, writing utensils and/or the like) in a main chamber or compartment or pouch (or multiple chambers or pockets), as with a conventional backpack, with the backpack of the present invention also including a clothing holder that facilitates organized storage of individual articles of clothing (such as, for example, gloves or mittens, hat, boots, jacket, snow pants and/or the like) in separate compartments of the clothing holder. The clothing holder permits surrounding air to flow through its compartments to facilitate drying the clothing articles stored therein, such as while the child is in the classroom and before the child has to put the clothing back on to go outside or to go home after school.

The clothing holder attaches to a main portion of the backpack, and may generally be in the shape of a person, including a pair of hand/arm portions and a pair of leg/foot portions for individual storage of handwear and footwear, respectively. For example, the clothing holder may include individual footwear storage compartments and handwear storage compartments for individual storage of hand wear (such as gloves or mittens) and footwear (such as shoes, boots, sandals and/or the like), and may also include a torso portion with another clothing storage compartment for storing a jacket, pants, hat, or the like. The person or body shape assists younger children in properly storing articles of clothing in the clothing holder to limit or reduce the loss of clothing when it is not being worn. Optionally, the clothing holder may be formed in other shapes, such as a rocket shape or airplane shape or bird shape (where the clothing holder may have wings or the like for holding hand wear and/or foot wear) or an animal shape or the like, with the shape preferably or desirably being selected to appeal to younger children. Optionally, the clothing holder may include any suitable or desired graphics to provide a desired appearance, such as cartoon characters or the like (for example, the clothing holder may have a cartoon character screened or printed on its surface that is viewable when the clothing holder is in its use state, where the user may readily recognize that the hands of the character are at the hand wear storage portions and the feet of the character are at the foot wear storage portions and the like, in order to further assist the cognitive recognition by the user of the purpose of the different storage compartments of the clothing holder). Optionally, the clothing storage compartments of the clothing holder are made at least partially of breathable fabric material, such as a mesh material, to promote air-drying of clothing articles stored in the compartments.

The clothing holder is configurable to a "stored" state and one or more "use" states. In the stored state, the clothing holder is folded or rolled and stored in a pouch of the backpack, or along an outer surface of the backpack, such that the backpack may be used in a normal manner for carrying various articles therein. In the use state, the clothing holder is substantially unfolded, and clothing articles may be stored in the various compartments of the clothing holder. Optionally, the clothing holder can be attached to an outer surface of the backpack or the clothing holder may be attached to an internal storage compartment of the backpack, whereby the internal storage compartment receives the clothing holder in its stored state. Optionally, the clothing holder is releasably or detachably attachable to the backpack.

The clothing holder may have articles of clothing disposed therein when in its use state, and the clothing holder (with the articles of clothing disposed therein) may be folded at least partially over itself and along the back of the backpack. When the clothing holder is folded in this manner, a lower portion or end of the clothing holder may be hooked or clipped or otherwise attached to or at an upper portion of the clothing holder or an upper portion of the backpack to retain the clothing holder in this folded orientation or transport orientation or configuration or state, such that the backpack (and clothing holder and clothing contained therein) may be carried or transported by a user while the clothing holder is being used to hold articles of clothing.

Thus, the combination backpack and clothing holder of the present invention provides a single-unit backpack with provisions for clothing storage in an associated clothing holder portion. The clothing holder portion provides separate compartments for individual articles of outerwear in an arrangement that facilitates use by even young children, who can remove their handwear and footwear and place these articles in respective storage compartments of the hand/arm portions and leg/foot portions of the clothing holder in a logical layout that generally resembles a person's body. The clothing holder further permits the user to readily recognize when an article of clothing is missing, while allowing moisture to evaporate from the clothing articles while they are stored in an organized and readily-identifiable manner.

These and other objects, advantages, purposes and features of the present invention will become apparent upon review of the following specification in conjunction with the drawings.

DESCRIPTION OF THE PREFERRED EMBODIMENTS

Figure 1:
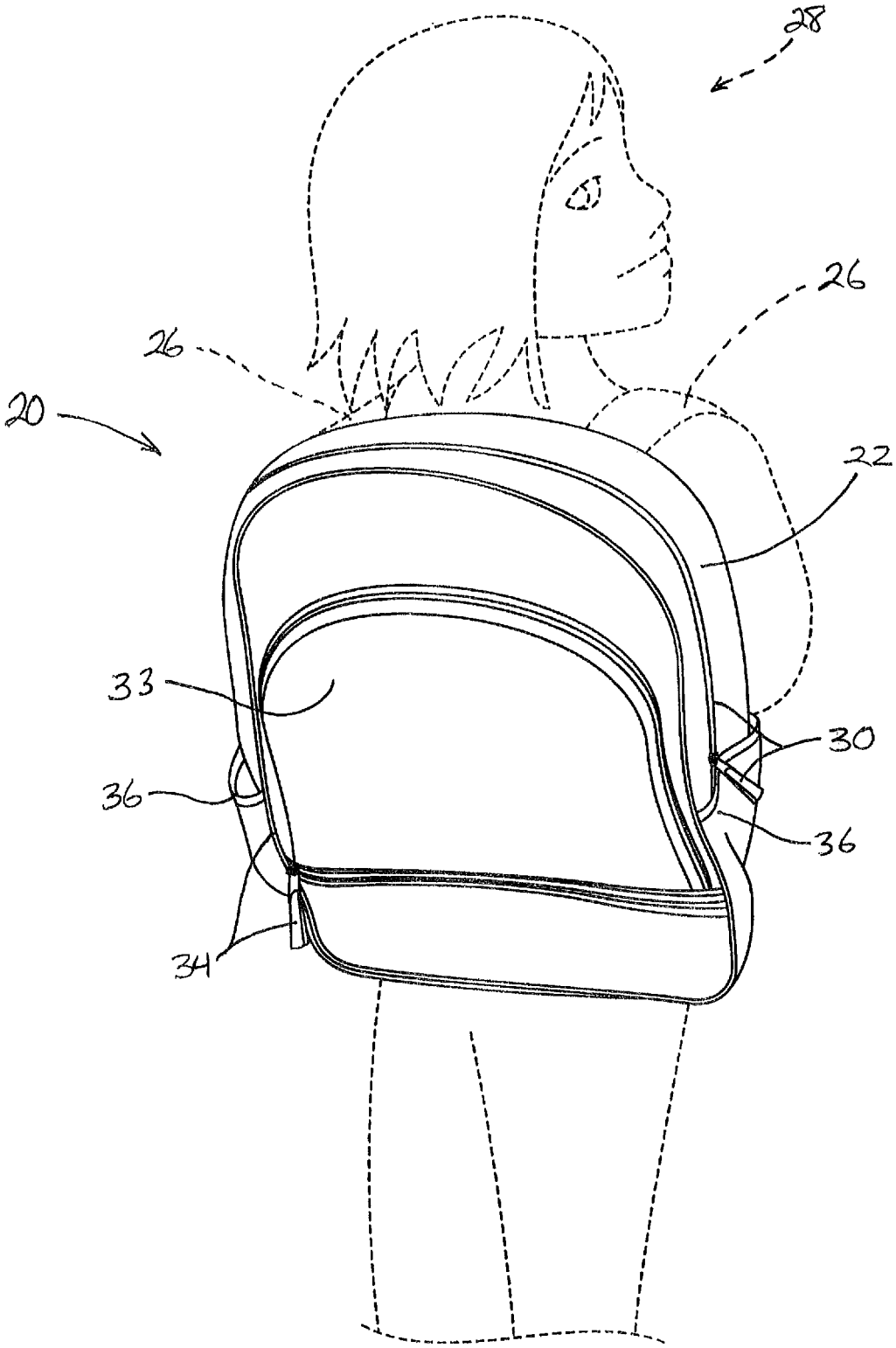
FIG. 1 is a perspective view of a combination backpack and clothing holder in accordance with the present invention, shown with the clothing holder in a stored state.
Figure 17:
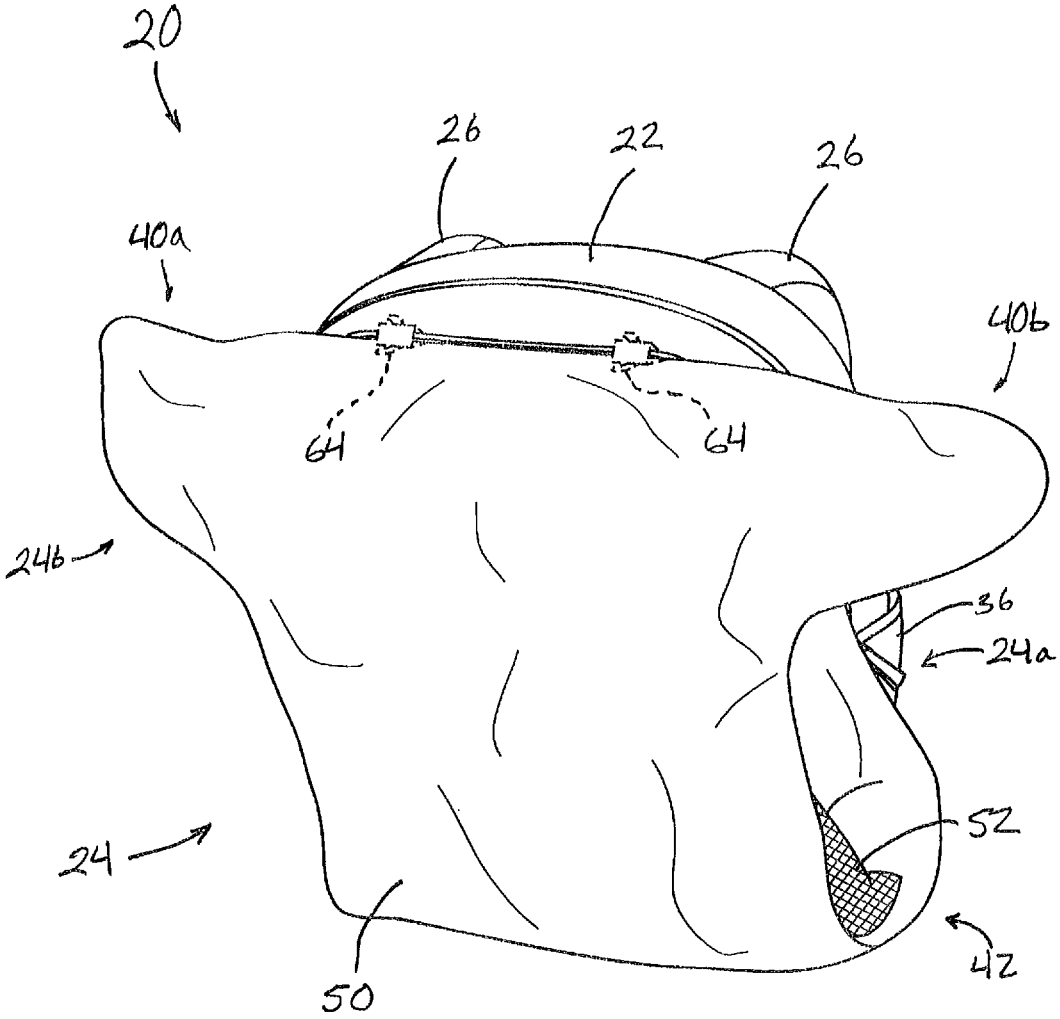
Figure 18:
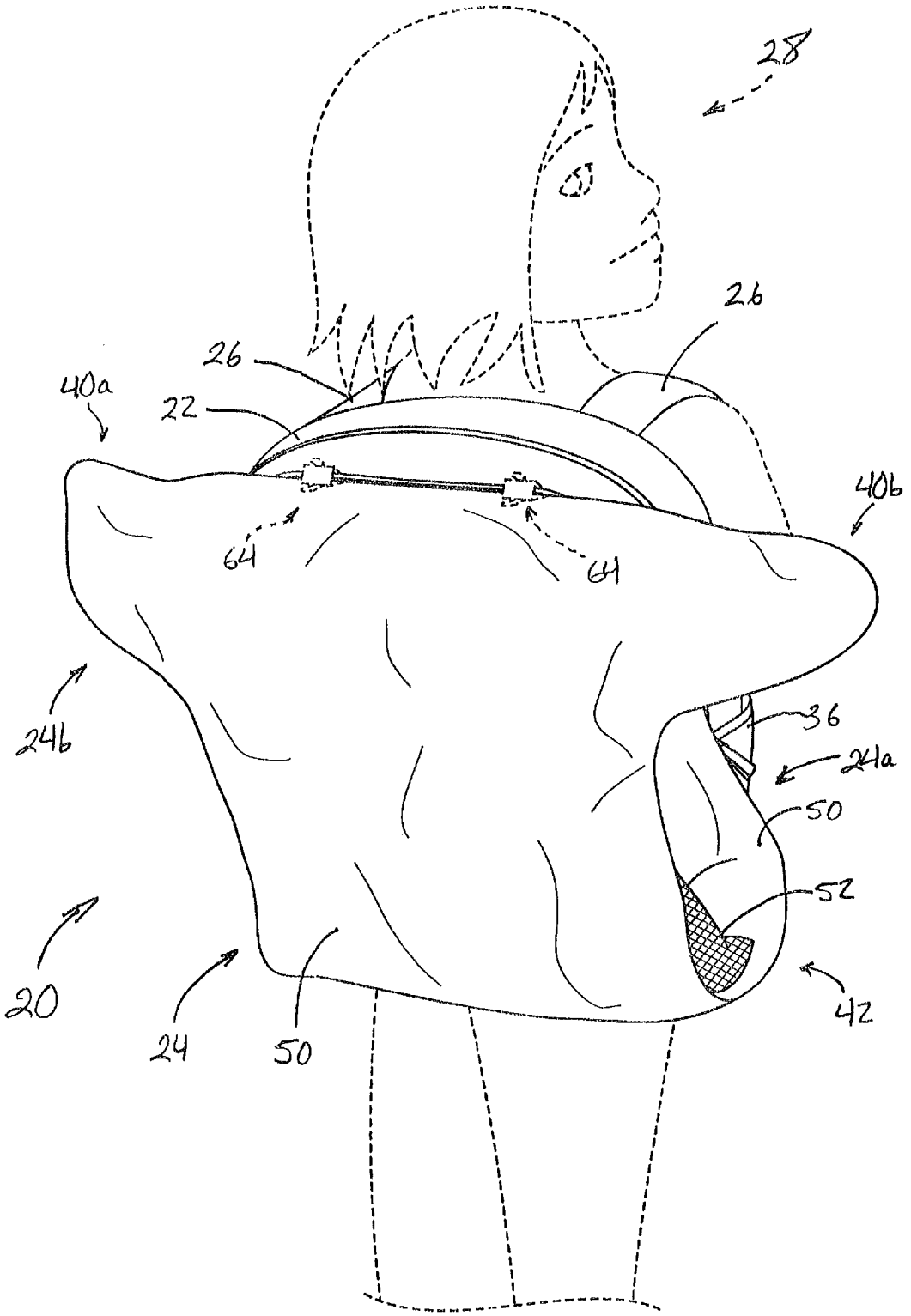

Referring now to the drawings and the illustrative embodiments depicted therein, a combination backpack and clothing holder 20 includes a wearable enclosure or backpack portion 22 and a garment bag portion or clothing holder portion 24, which is attached or is attachable to backpack portion 22 (FIGS. 1-5). This allows backpack portion 22, which includes a pair of shoulder straps 26, to be used as a backpack (i.e., for holding books, papers, writing utensils, electronics and/or the like), while clothing holder portion 24 may be configured between a stored state (such as shown in FIG. 1), a use state (such as shown in FIGS. 2-5, 13 and 14), and a stored-use state or transport state (such as shown in FIGS. 17 and 18) for storing individual articles of clothing in an organized manner and allowing for transport of the backpack when the clothing holder is holding or storing articles of clothing. When in the use state (such as shown in FIGS. 2-5, 13 and 14), the clothing holder may facilitate or enhance drying of clothing stored therein and reduces the risk of misplacing individual articles of clothing when the clothing and combination backpack and clothing holder 20 are not being worn or carried.

Backpack portion 22 may comprise a substantially conventional backpack, including at least one main internal storage compartment that is selectively openable and closable via a closure 30, such as a zipper or the like. In the illustrated embodiment of FIGS. 1-5 and 11-18, backpack portion 22 includes a second internal storage compartment or pocket 32 defined in part by a flap 33 and a closure 34, for receiving and containing clothing holder portion 24 in its stored state. It will be appreciated that backpack portion 22 may include or define substantially any number of additional pouches, pockets, enclosures or the like, such as open side pockets 36 (FIGS. 1-5 and 11-18) or the like, without departing from the spirit and scope of the present invention.

Figure 2:
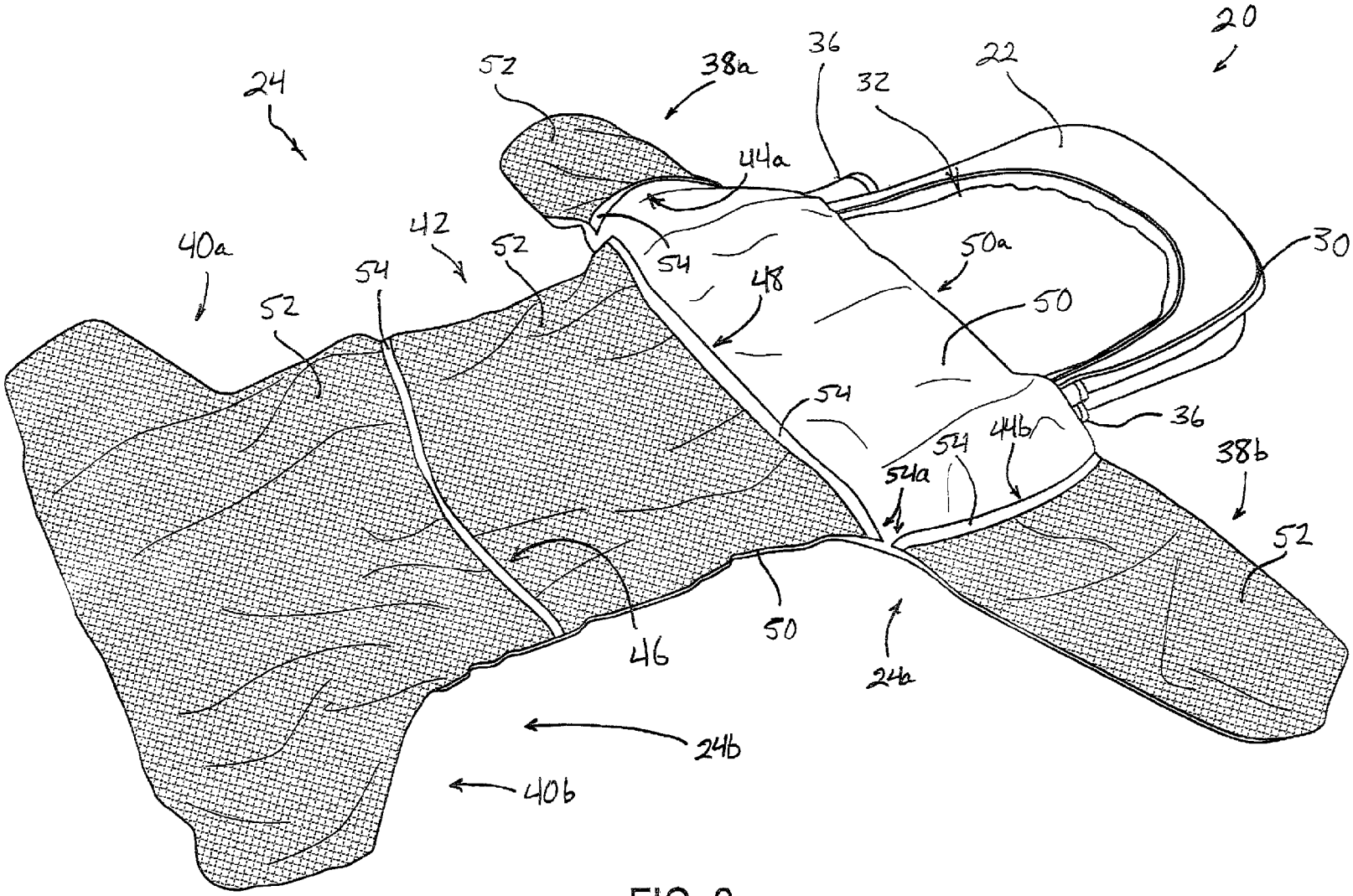
FIG. 2 is a perspective view of the combination backpack and clothing holder of FIG. 1, shown with the clothing holder in a use state.

As shown in FIG. 2, clothing holder portion 24 may be readily reconfigured to its use state upon opening second internal storage compartment or pocket 32 and unfolding or unfurling the clothing holder portion 24. Clothing holder portion 24 has an upper or proximal end portion 24*a* and a lower or distal end portion 24*b* (FIGS. 2-5), and in its unfolded use state, it bears at least a loose resemblance to a human body form or shape, including left and right hand/arm portions 38*a*, 38*b*, left and right leg/foot portions 40*a*, 40*b*, and a torso portion 42. Each of the left and right hand/arm portions 38*a*, 38*b* defines a respective left or right handwear storage compartment 44*a*, 44*b*, while left and right leg/foot portions 40*a*, 40*b* define a single footwear storage compartment 46 for storing two articles of footwear (such as left and right shoes or boots), and torso portion 42 defines a storage compartment 48 for jacket and/or snow pants and/or other articles of clothing.

Although left and right leg/foot portions 40*a*, 40*b* form a generally contiguous footwear storage compartment 46 at distal end portion 24*b* of clothing holder 24, for receiving at least two articles of footwear (such as a matching pair of shoes, boots and/or socks), it will be appreciated that the left leg/foot portion could form a distinct left footwear storage compartment and the right leg/foot portion could form a distinct right footwear storage compartment, without departing from the spirit and scope of the present invention. It will further be appreciated that substantially any other number of additional pouches or compartments, either with or without releasable closures (e.g. buttons, snaps, hook-and-loop fasteners, magnetic fasteners, zippers, or the like) may be provided at the clothing holder portion.

In the illustrated embodiment, clothing holder portion 24 is made up of a base sheet 50 of flexible fabric material such as woven nylon or the like, which has an upper or proximal end portion 50*a* that may be either releasably or fixedly attached to backpack portion 22 inside second internal storage compartment 32 (FIG. 2). For example, the upper or proximal end portion 50*a* may be secured or attached (such as via stitching or the like) to an internal surface or portion of the compartment or pocket 32. It will be appreciated that when clothing holder portion 24 is releasably or detachably attached (such as via hooks or clips or VELCRO® type hook and loop attachment means or the like), it may be separated from backpack portion 22 and hung or stored separately, so that clothing holder portion 24 and backpack portion 22 could be used independently, if desired.

Figure 3:
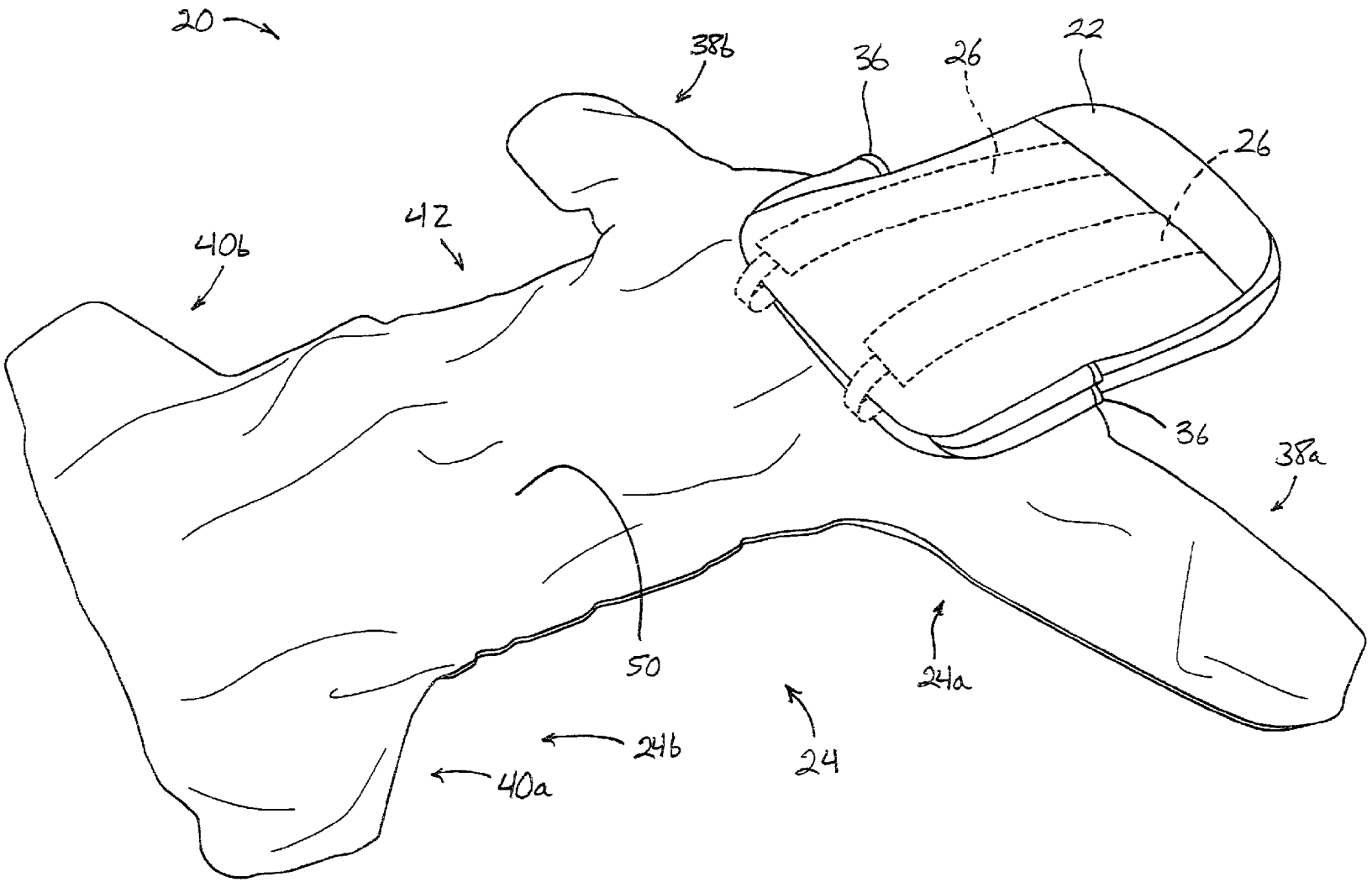
FIG. 3 is an opposite perspective view of the combination backpack and clothing holder of FIG. 2.
Figure 4:
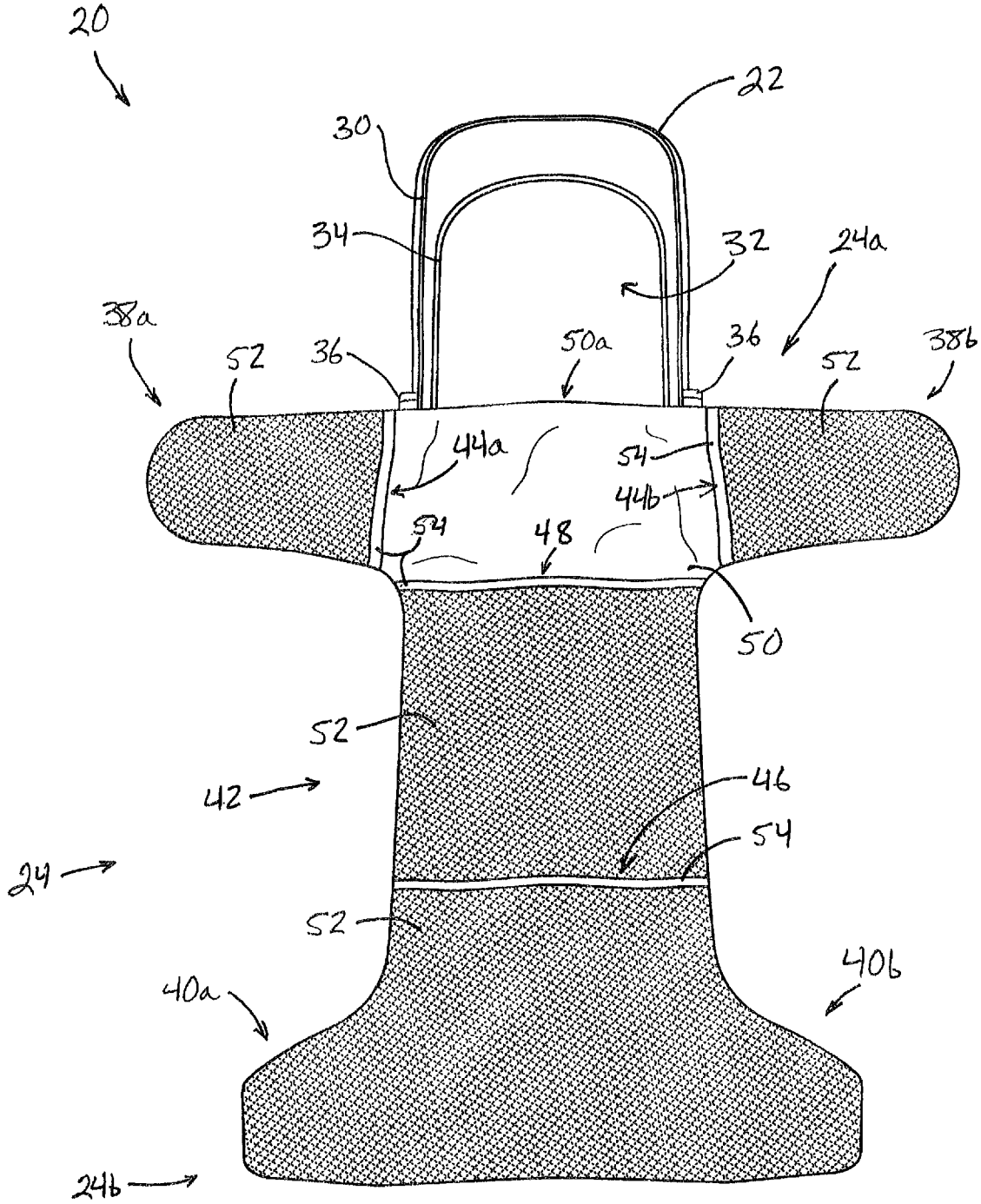
FIG. 4 is a plan view of the combination backpack and clothing holder of FIG. 2.
Figure 5:
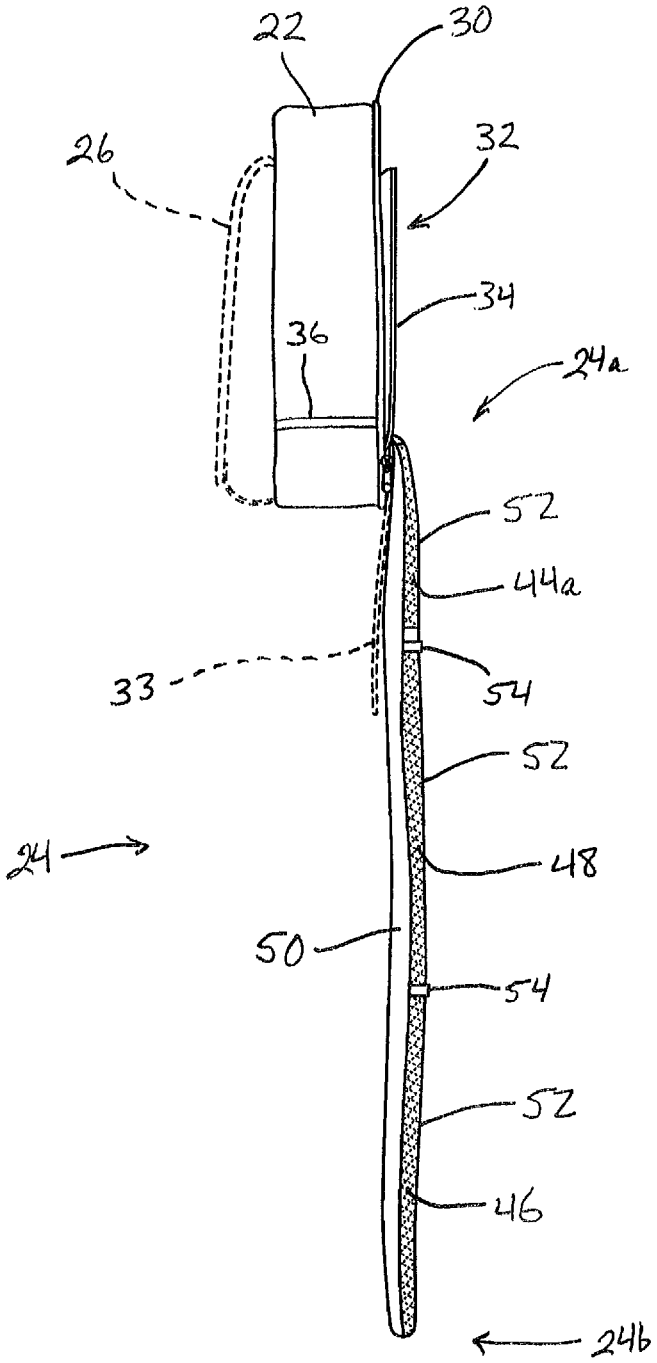
FIG. 5 is a side elevation of the combination backpack and clothing holder of FIG. 2.

As shown in FIGS. 2-4, an additional layer of breathable fabric 52, such as a mesh material or the like, is sewn or bonded or otherwise attached in any suitable manner to the perimeter regions or portions of base sheet 50 to form pockets or receptacles, such as the handwear storage compartments 44*a*, 44*b*, footwear storage compartment 46, and jacket storage compartment 48. Portions of mesh material 52 that span across base sheet 50 are left unsewn to form an opening that allows for the insertion and removal of clothing articles from the respective compartments. Optionally, a strip of reinforcement material 54 is sewn to mesh sheets 52 at the respective compartment openings formed between mesh sheets 52 and base sheet 50. To further increase durability, opposite end portions 54*a* (FIG. 2) of the reinforcement strips 54 may be sewn to base sheet 50 to reduce the concentration of stresses applied to mesh sheets 52 during insertion and removal of clothing articles from the respective storage compartments. Optionally, and desirably, the reinforcement strips and the mesh material may comprise an elastic material to allow for insertion of larger articles into the pockets and to provide partial closure of the pockets as the strips or material return towards their initial non-stretched state after the articles are inserted into the respective pocket or pockets.

Although shown and described as being in the general shape of a person's body, optionally, the clothing holder may be formed in other shapes, while remaining within the spirit and scope of the present invention. For example, the clothing holder may be formed generally as a rocket shape or airplane shape or bird shape (where the clothing holder may have wings or the like for providing the compartments for holding hand wear and/or foot wear) or an animal shape or the like (where the legs/paws may form or provide the compartments for holding hand wear and/or foot wear), with the shape preferably or desirably being selected to appeal to younger children. Optionally, the clothing holder may include any suitable or desired graphics to provide a desired appearance, such as cartoon characters or the like screened or printed or otherwise established at the surface of the base sheet 50 that faces the mesh sheets 52. For example, the clothing holder may have a cartoon character (such as a character of a person or animal or airplane or rocket or the like) screened or printed or otherwise established on the surface of the base sheet that is viewable when in the clothing holder is in its use state, where the user may readily recognize that the hands (or wings or legs or paws or the like) of the character are at the hand wear storage compartments and the feet (or wings or legs or paws or the like) of the character are at the foot wear storage compartments and the like, in order to further assist the cognitive recognition by the user of the purpose of the different storage compartments of the clothing holder.

Optionally, the clothing holder may be attached (and desirably detachably attached) at an outer portion of the backpack so as to not be included inside a compartment or pocket of the backpack. For example, and with reference to FIGS. 6-10, a combination backpack and clothing holder 120 includes a wearable enclosure or backpack portion 122 and an externally-mounted garment bag portion or clothing holder portion 124. Aside from clothing holder portion 124 being mounted to an external surface of the backpack portion 122, combination backpack and clothing holder 120 is substantially similar to combination backpack and clothing holder 20, described above, such that a detailed discussion of the combinations need not be repeated herein. In FIGS. 6-10, components of combination backpack and clothing holder 120 that correspond to like components of combination backpack and clothing holder 20 are given like numerals with the addition of 100, and may be readily understood with reference to the above description.

Figure 6:
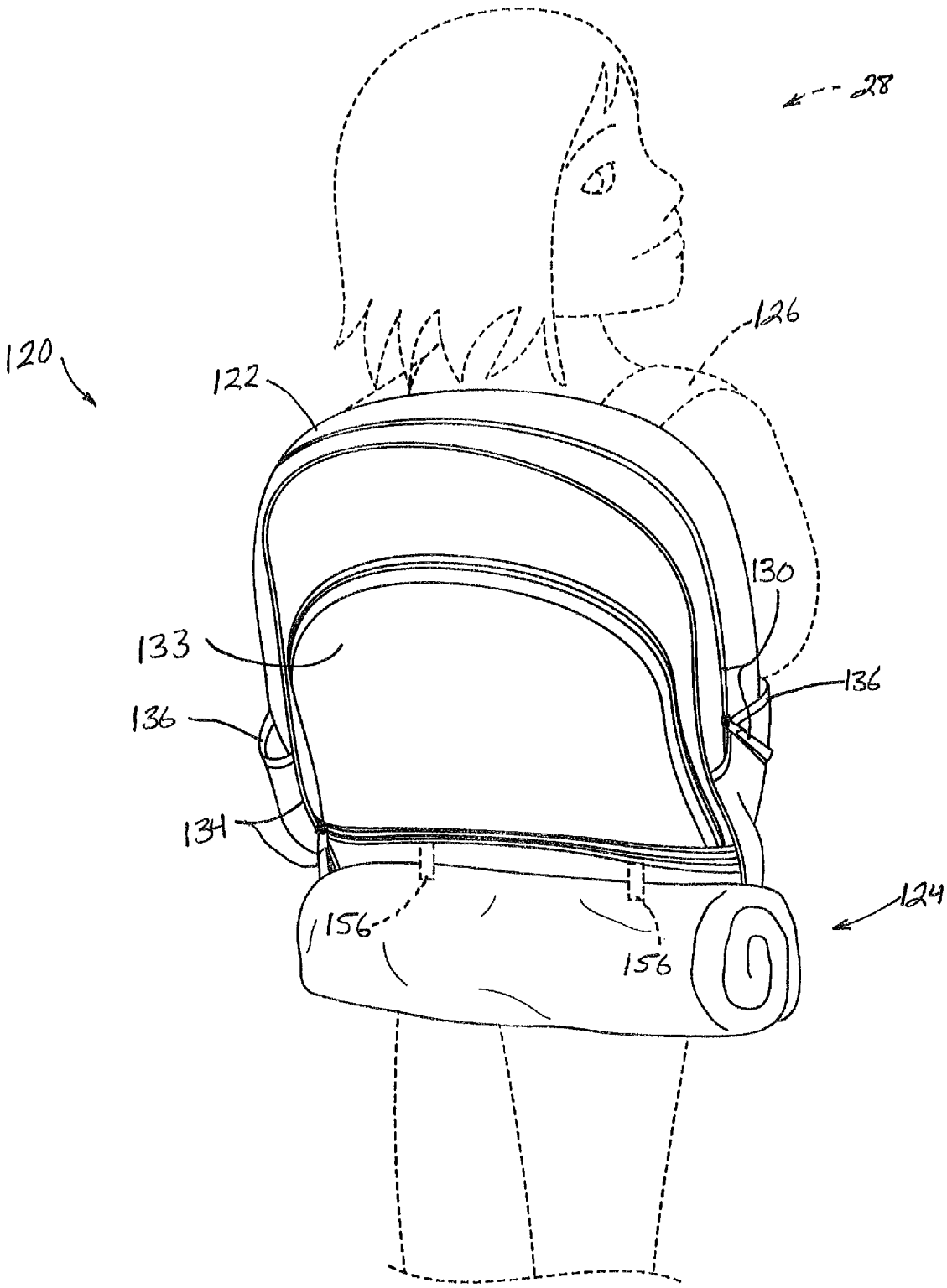
FIG. 6 is a perspective view of another combination backpack and clothing holder in accordance with the present invention, shown with the clothing holder in a stored state.
Figure 7:
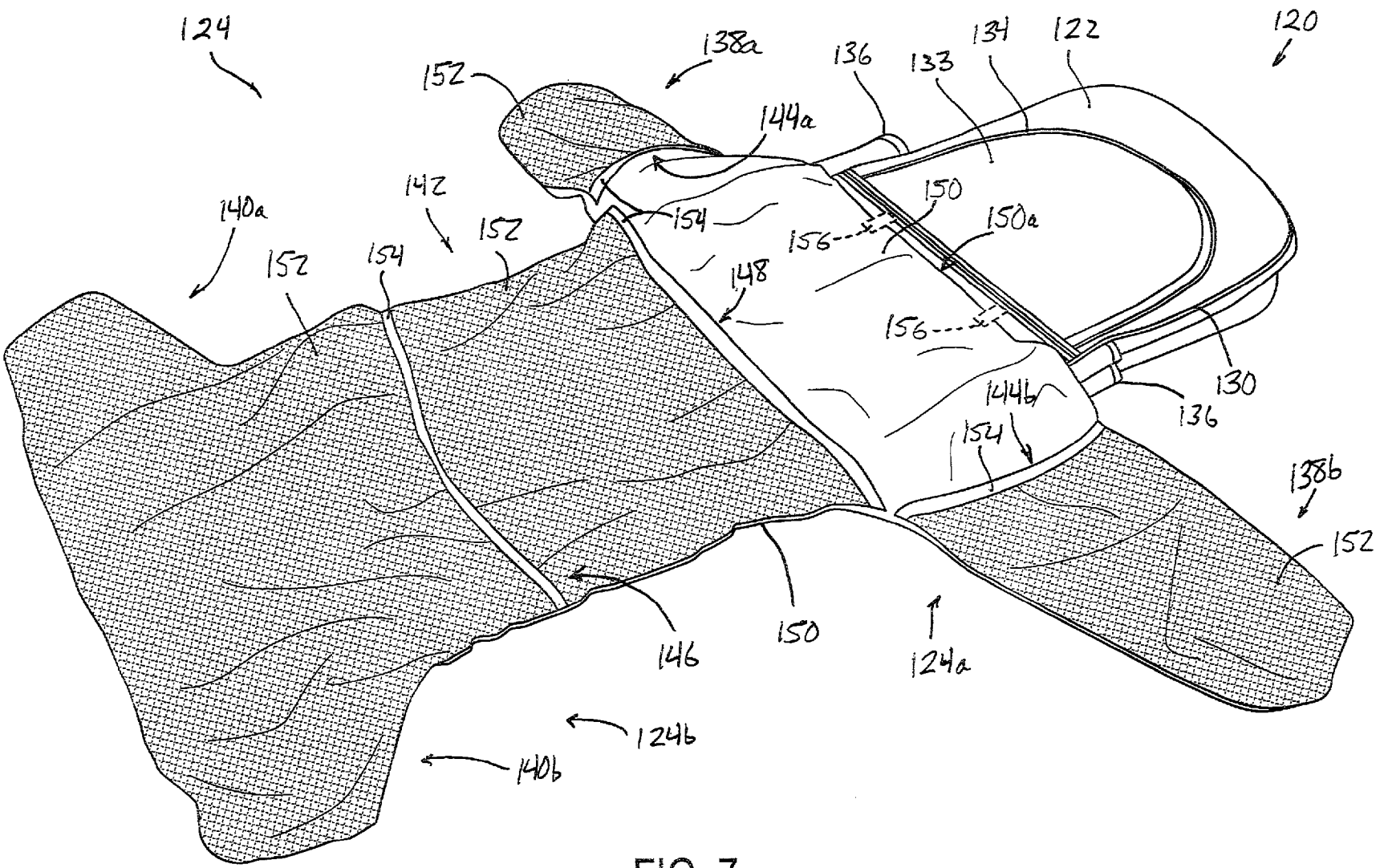
FIG. 7 is a perspective view of the combination backpack and clothing holder of FIG. 6, shown with the clothing holder in a use state.
Figure 8:
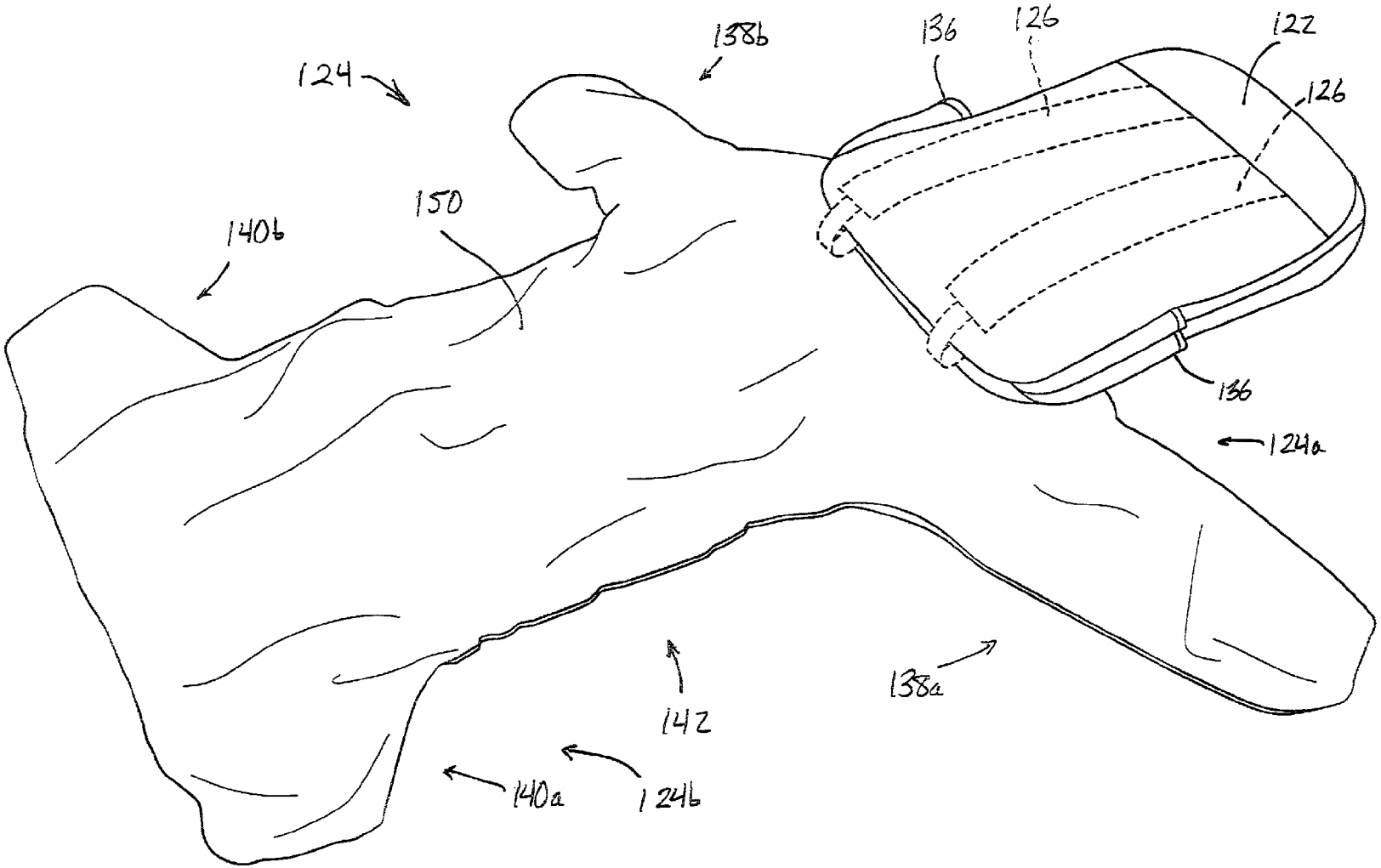
FIG. 8 is an opposite perspective view of the combination backpack and clothing holder of FIG. 7.
Figure 9:
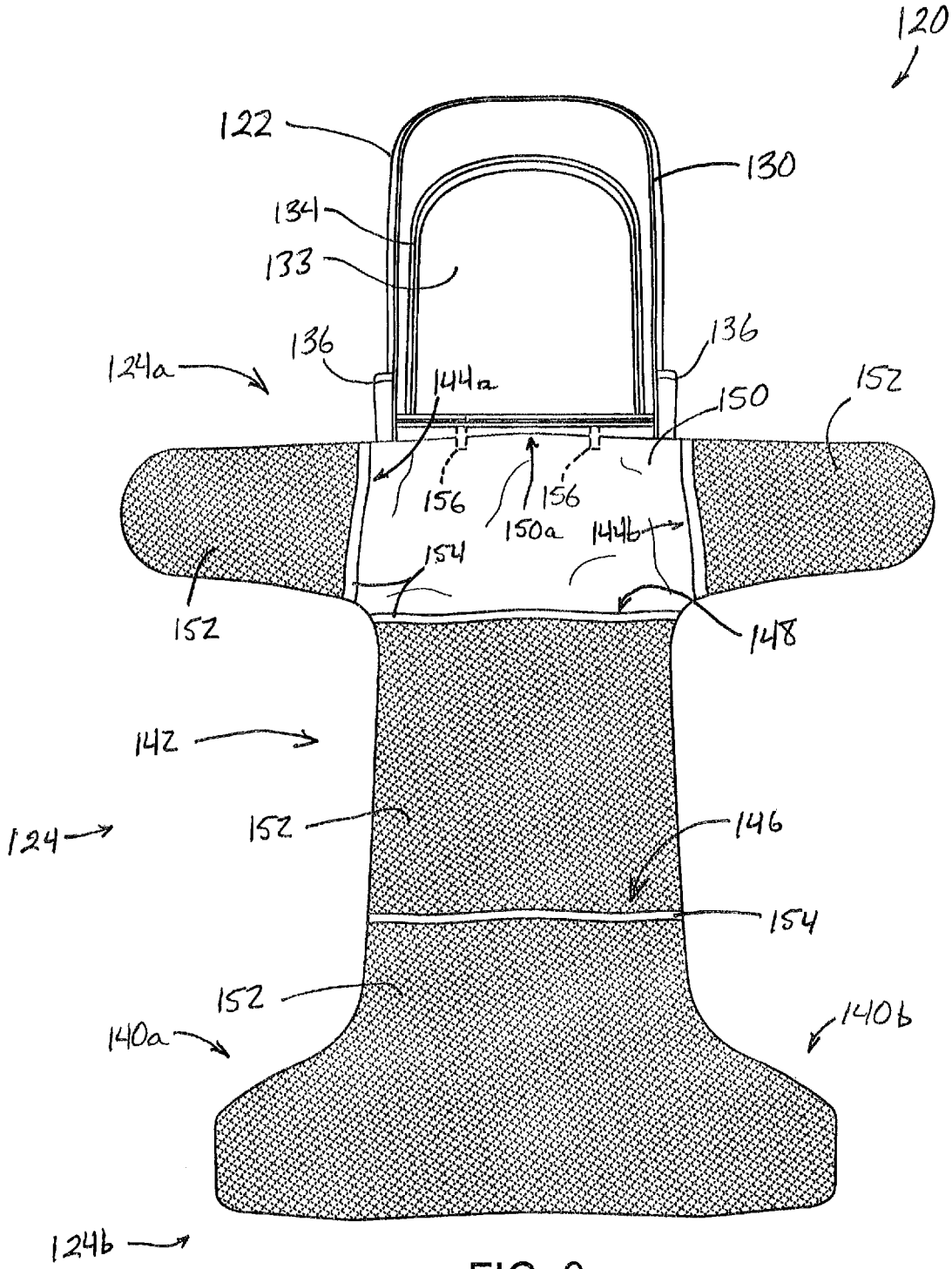
FIG. 9 is a plan view of the combination backpack and clothing holder of FIG. 7.
Figure 10:
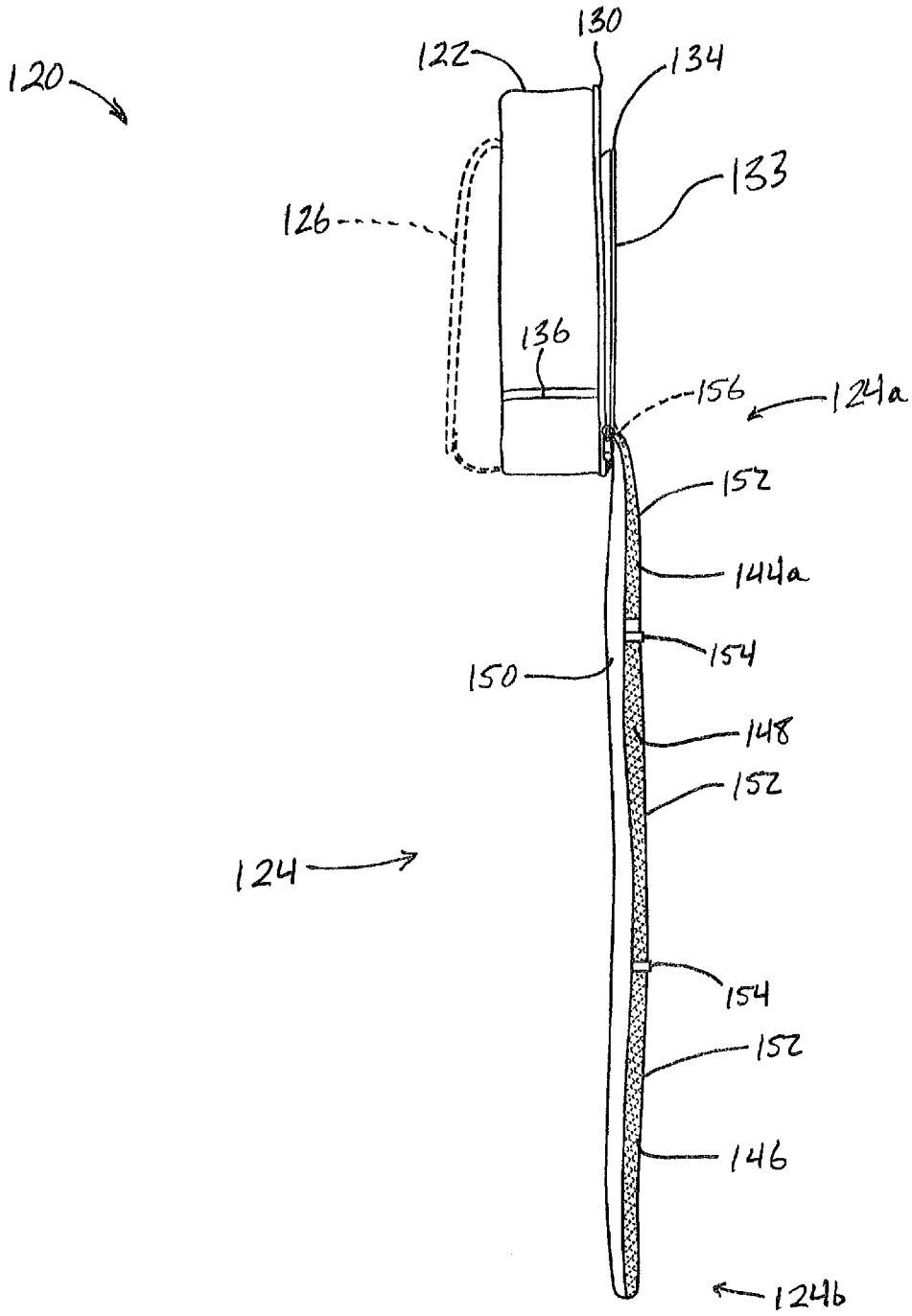
FIG. 10 is a side elevation of the combination backpack and clothing holder of FIG. 7.

Clothing holder portion 124 may be folded and rolled in its stored state, in which it is attached to an outer surface of backpack portion 122 via any suitable attachment means, such as a pair of fasteners or tabs or strips 156, as shown in FIG. 6. Fasteners 156 may be sewn or bonded or otherwise attached to base sheet 150 of clothing holder portion 124, and to the outer surface of backpack portion 122, in order to attach or retain clothing holder portion 124 along backpack portion 122 in either the stored state or the use state. Optionally, fabric strips may be attached to the backpack and may be long enough to encompass the clothing holder when the clothing holder is rolled up into its stored state, whereby a user may tie the strips around the stored clothing holder to attach the clothing holder and retain the clothing holder in its stored state, or other attachment means may be incorporated to retain the clothing holder in its stored state at the backpack. Optionally, any suitable fasteners may be used, including buttons, snaps, hook-and-loop fasteners, zippers, or the like. It will be appreciated that similar fasteners or tabs may be used on the combination backpack and clothing holder of FIGS. 1-5, described above, to fasten or attach upper end portion 50*a* of base sheet 50 to the second internal storage compartment 32 of backpack portion 22. There may be two types of fasteners, with one fastener type (such as clips or snaps or buttons or the like) attaching the upper end 150*a* to the rear surface or portion of the backpack, and with another fastener type (such as strips or ties or the like) for retaining the clothing portion in its rolled up or stored state.

Figure 11:
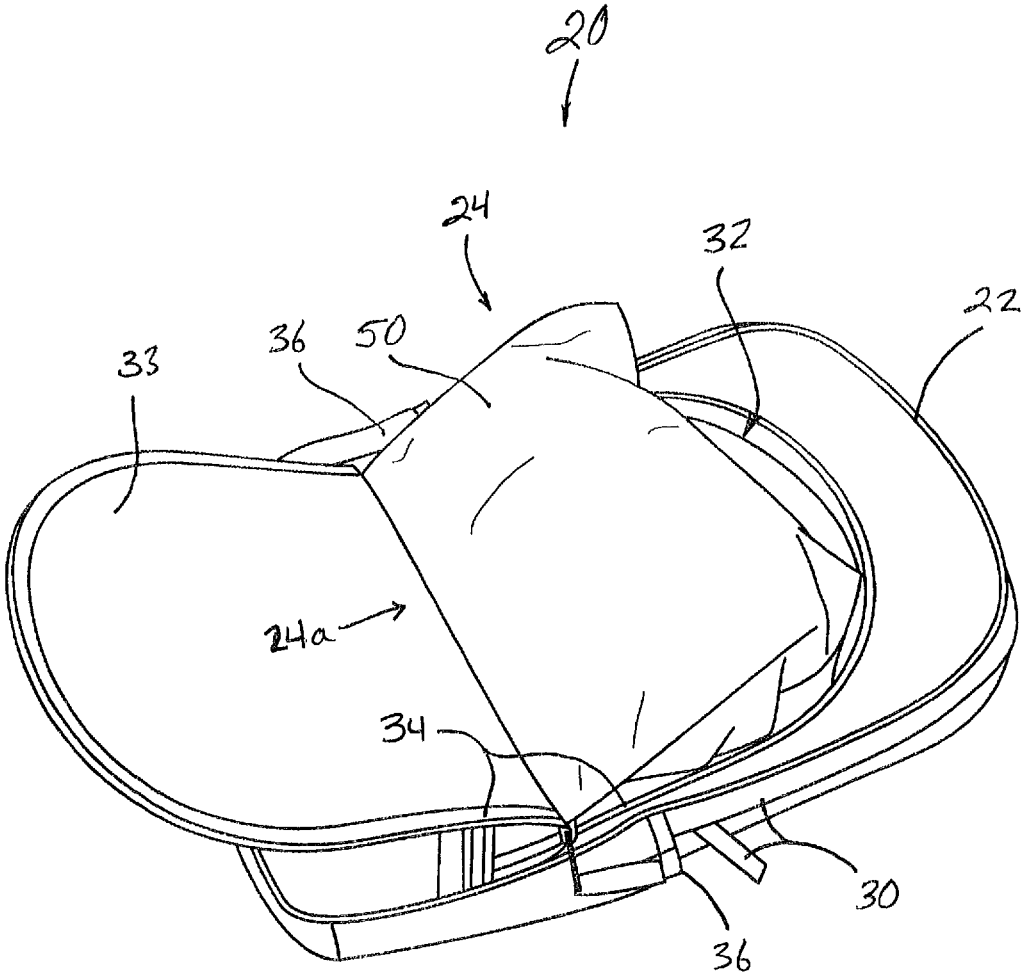
FIGS. 11-14 are perspective views of the combination backpack and clothing holder of FIG. 1, depicting sequential steps of unfolding or deploying the clothing holder from its stored state to its use state.
Figure 12:
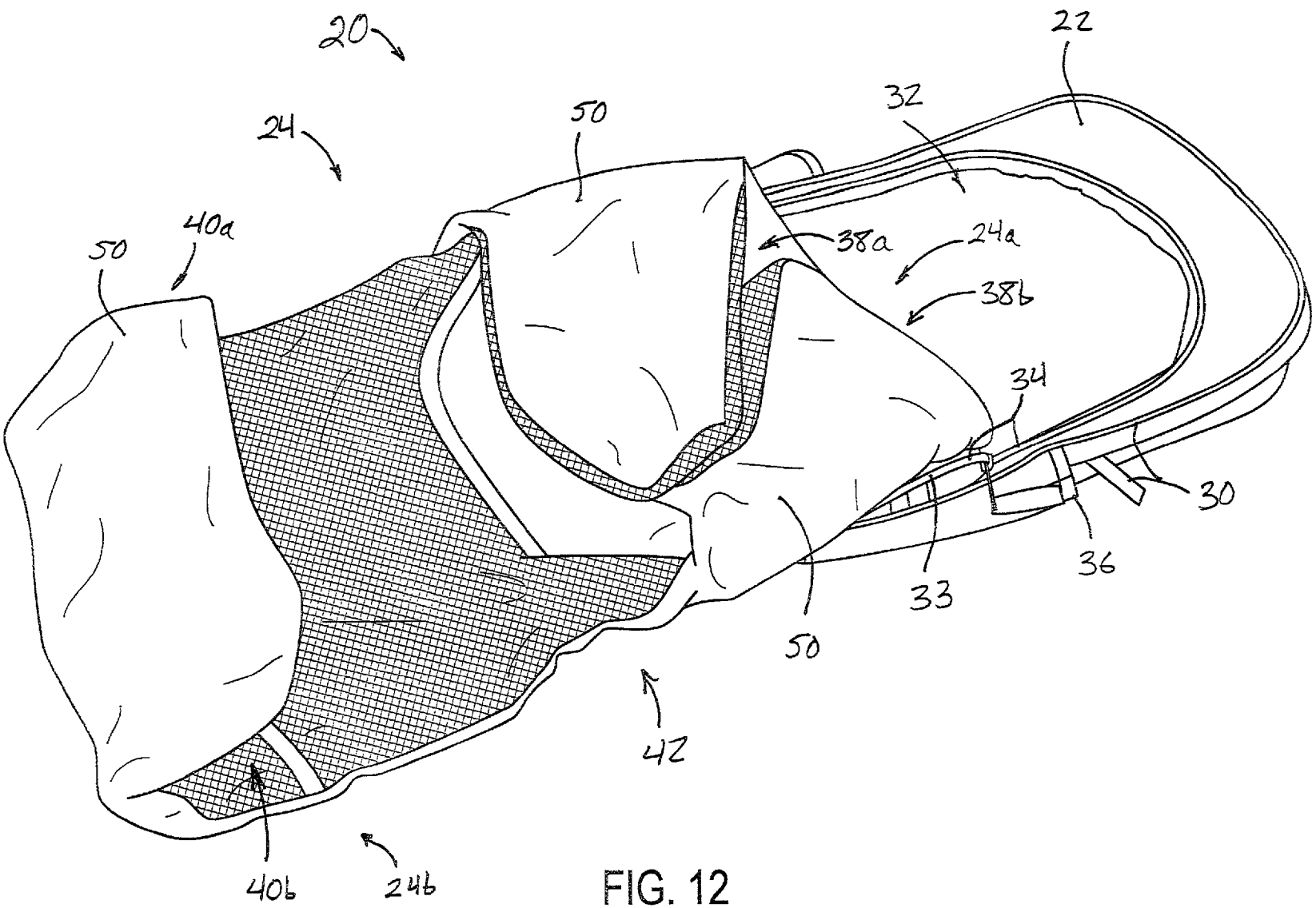

Referring now to FIGS. 11-18, clothing holder portion 24 may be configured between its stored state (FIG. 11), its unfolded or unfurled use state (FIG. 14), and a folded or transport or ready-to-carry stored-use state (FIGS. 17 and 18). Clothing articles may be stored in the clothing holder portion 24 in the use state or the stored-use state, while the stored state corresponds to a the clothing holder 24 being substantially empty and folded to a compact state for storage (either in or at the outer surface of the backpack) during periods of non-use. To unfold or deploy clothing holder portion 24 from the stored state to the unfolded use state of FIG. 14, a user begins by opening closure 34 and pulling flap 33 outwardly to expose second internal storage compartment 32, which houses or contains clothing holder portion 24 in the stored state, as shown in FIG. 11. After clothing holder portion 24 is exposed, torso portion 42 and leg/foot portions 40*a*, 40*b* are at least partially unfolded toward the unfolded use position, as shown in FIG. 12. From the partially unfolded configuration of FIG. 12, clothing holder portion 24 may be fully unfolded to the use configuration of FIG. 13 by unfolding leg/foot portions 40*a*, 40*b* and hand/arm portions 38*a*, 38*b*.

Figure 13:
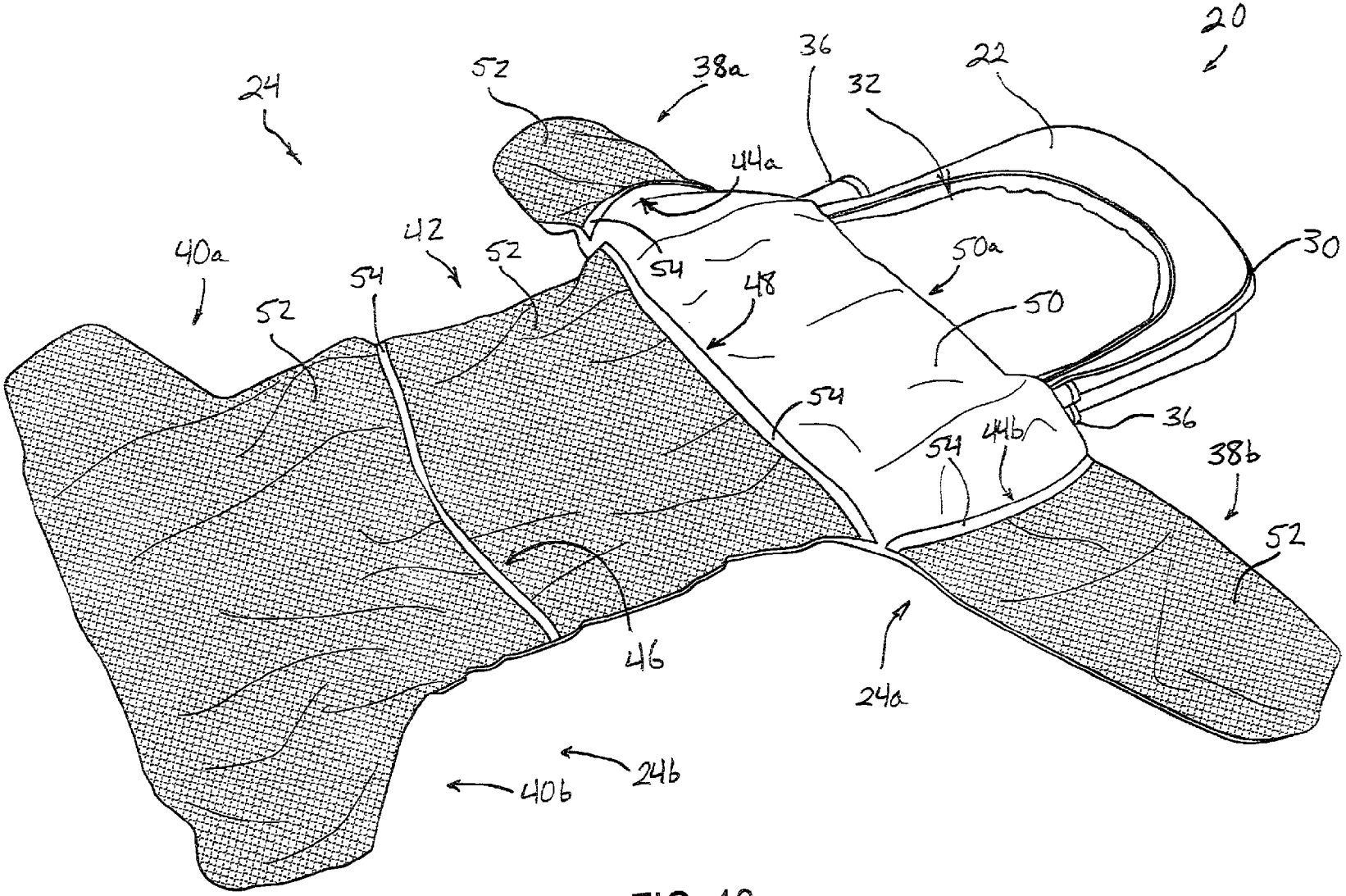
Figure 14:
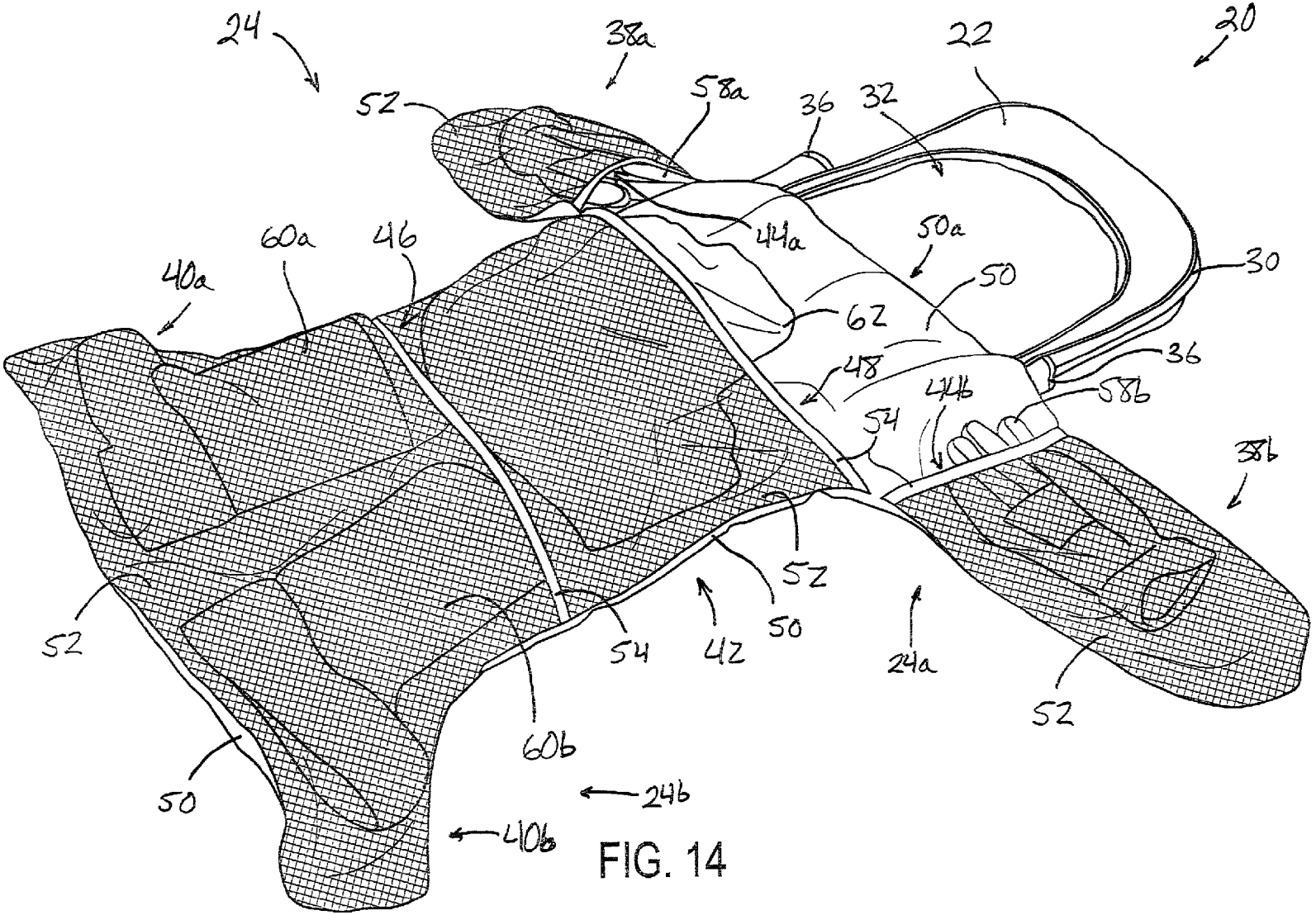

Once clothing holder portion 24 is in the use configuration of FIG. 13, clothing articles may be inserted into the respective storage compartments formed between mesh sheets 52 and base sheet 50, as shown in FIG. 14 (and this can be done while the backpack is hung on a wall or coat rack or the like or while the backpack is on a support surface or floor or the like). For example, left and right gloves 58*a*, 58*b* may be positioned in the respective left and right handwear storage compartments 44*a*, 44*b*, while left and right boots 60*a*, 60*b* may be inserted into footwear storage compartment 46 at respective left and right leg/foot portions 40*a*, 40*b*, and a jacket 62 may be positioned in the jacket storage compartment 48. Thus, the individual articles of clothing may be logically organized and arranged in a manner that leaves them visible and exposed to airflow from the surrounding environment, allowing them to dry if necessary, while securing them to the backpack portion 22. With clothing holder portion 24 in the use configuration of FIG. 14, backpack portion 22 may be hung or supported or suspended from a hook or the like, so that clothing holder portion 24 hangs generally below backpack portion 22. This may cause head/arm portions 38*a*, 38*b* of clothing holder portion 24 to droop or hang alongside torso portion 42.

Figure 15:
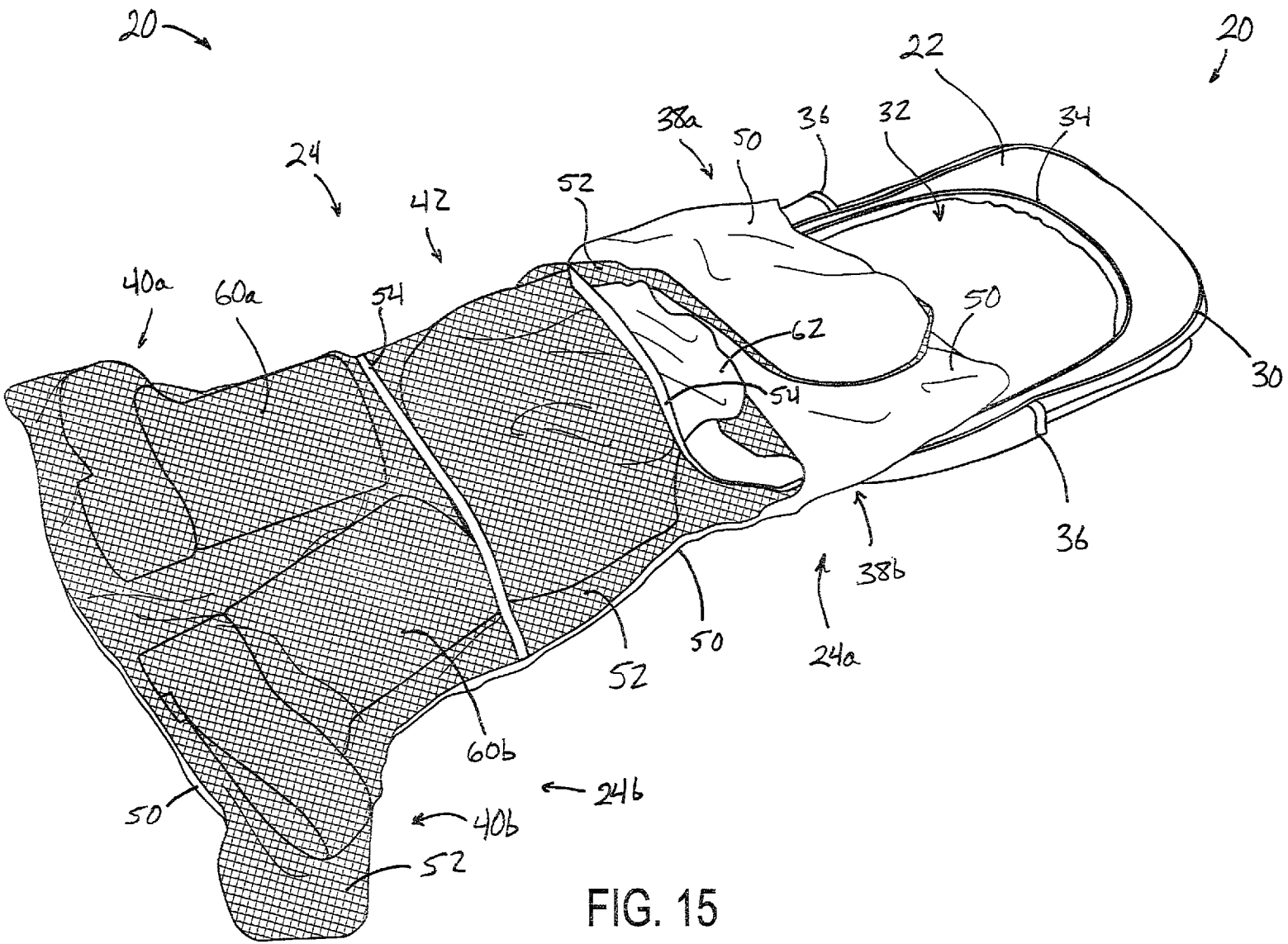
FIGS. 15-18 are perspective views of the combination backpack and clothing holder of FIG. 1, depicting sequential steps of folding the clothing holder portion of the combination backpack and clothing holder from a partially-folded use state to a stored-use state.
Figure 16:
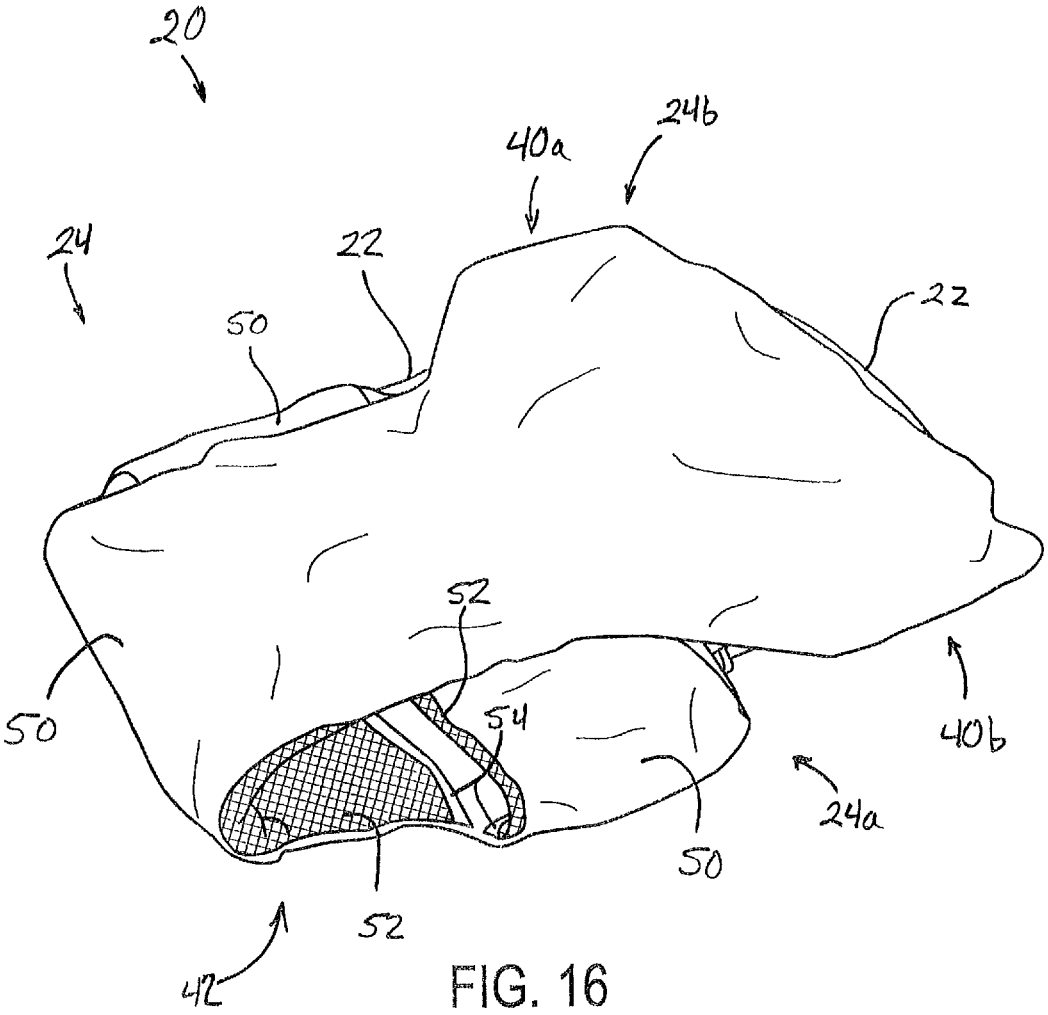

If desired, the user can partially fold clothing holder portion 24 to the stored-use or transport configuration with the clothing articles positioned in their respective storage compartments, such as by following the sequential steps depicted in FIGS. 15-17. In the stored-use or transport configuration, combination backpack and clothing holder 20 may be carried by the wearer 28 without first removing the clothing articles from the compartments of clothing holder portion 24 (such as shown in FIG. 18). Referring to FIG. 15, left and right hand/arm portions 38*a*, 38*b* may be folded inwardly over one another in an overlapping fashion, which retains left and right gloves 58*a*, 58*b* in their respective handwear storage compartments 44*a*, 44*b*, and clothing holder portion 24 may then be folded along torso portion 42, as shown in FIG. 16, so that left and right leg/foot portions 40*a*, 40*b* at least partially overlap hand/arm portions 38*a*, 38*b*, which also serves to retain boots 60*a*, 60*b* in footwear storage compartment 46, while securely retaining jacket 62 in jacket storage compartment 48.

When folded such as shown in FIGS. 16 and 17, the lower end portion of the leg/foot portions 40*a*, 40*b* may be attached to an upper portion of the backpack 22, so that the backpack can be moved or carried with the clothing stored in the clothing holder and without the clothing holder dragging on the ground. Optionally, a pair of clips 64 or ties or other types of releasable fasteners allow distal portion 24*b* of clothing holder portion 24 to be attached the upper portion or region of backpack portion 22, such as at a location above the closure or zipper 34 of compartment or pocket 32 and below the closure or zipper 30 of the main compartment or pocket of the backpack, such as shown in FIG. 17. With clothing holder portion 24 in the folded or partially stored or transport state of FIG. 17, the combination backpack and clothing holder 20 may be worn or carried in the same or similar manner as a conventional backpack, with all of the clothing articles securely stored in their respective storage compartments of the clothing holder portion 24, such as shown in FIG. 18.

The clothing holder thus may have articles of clothing stored or contained or held therein when in its use state, and the clothing holder (with the articles of clothing disposed therein) may be folded at least partially over itself and along the back of the backpack. When the clothing holder is folded in this manner, the lower portion or end of the clothing holder may be hooked or clipped or otherwise attached to or at an upper portion of the clothing holder or an upper portion of the backpack to retain the clothing holder in this folded orientation or transport orientation or configuration or state. The backpack (and clothing holder and clothing contained therein) may then be readily carried or transported by a user (such as in a normal manner at the back of the user via the shoulder straps of the backpack) while the clothing holder is being used to hold articles of clothing.

Therefore, the present invention provides a combination backpack and clothing holder that stores individual articles of clothing (such as outerwear or the like) in an organized and visible manner, and which further permits air circulation around stored clothing articles, particularly when the clothing holder is in an unfolded use state. The combination backpack and clothing holder may be well-suited for elementary school aged children, particularly in classroom settings in which many young children may need to store wet clothing in a confined space which otherwise would not promote drying or organization of the individual clothing articles. When the clothing holder portion is not used for storing clothing articles, the clothing holder portion may be folded or rolled to a compact stored configuration or storage state, and may be stowed in an internal storage compartment or pouch of the backpack, may be stowed or positioned along an outer surface of the backpack. The clothing holder portion may also be folded to achieve a partially folded or stored-use state in which clothing articles are stored in its respective storage compartments, enabling the clothing articles to be securely stowed and carried in the combination backpack and clothing holder when the clothing articles are not being worn.

Changes and modifications to the specifically described embodiments may be carried out without departing from the principles of the present invention which is intended to be limited only by the scope of the appended claims, as interpreted according to the principles of patent law, including the doctrine of equivalents.

The embodiments of the invention in which an exclusive property is claimed are defined as follows:

1. A combination backpack and clothing holder comprising:

a backpack portion defining at least one internal storage compartment and configured to be supported on a wearer's shoulders or back;

a clothing holder having the general shape of a body including a torso portion, a pair of arm portions extending outwardly from said torso portion, and a pair of leg portions extending outwardly from said torso portion;

wherein said torso portion of said clothing holder is attached to said backpack portion, wherein said clothing holder is configurable between a compact stored state in which said clothing holder is rolled or folded, and an unfurled use state in which said clothing holder is deployed and is configured to receive and store articles of clothing therein, and wherein said torso portion remains attached to said backpack portion in both the compact stored state and the unfurled use state; and wherein said clothing holder has a plurality of clothing storage compartments that are configured to receive different articles of clothing, said clothing storage compartments including a handwear-storage compartment at each of said arm portions and a footwear-storage compartment at each of said leg portions.

2. The combination backpack and clothing holder of claim 1, wherein said clothing holder comprises a breathable fabric material to promote air-drying of clothing articles stored in said clothing storage compartments.

3. The combination backpack and clothing holder of claim 1, wherein said torso portion is generally in the shape of one chosen from (i) a human torso, (ii) a rocket body, (iii) an airplane body, (iv) a bird body, and (iv) an animal body.

4. The combination backpack and clothing holder of claim 1, wherein said clothing holder is attached at an outer surface of said backpack portion.

5. The combination backpack and clothing holder of claim 1, further comprising a second internal storage compartment, wherein said clothing holder is attached at said backpack portion inside of said second internal storage compartment.

6. The combination backpack and clothing holder of claim 5, further comprising a flap and a closure for selectively opening and closing said second internal storage compartment, said flap and said closure configured to fully enclose said clothing holder in said stored state inside of said second internal storage compartment.

7. The combination backpack and clothing holder of claim 1, wherein said clothing holder is releasably attachable to said backpack portion.

8. The combination backpack and clothing holder of claim 1, wherein said torso portion comprises a storage compartment for storing a jacket and/or pants and/or a hat.

9. The combination backpack and clothing holder of claim 1, wherein said clothing holder is at least partially rolled when in said stored state.

10. The combination backpack and clothing holder of claim 1, further comprising at least one shoulder strap at said backpack portion.

11. The combination backpack and clothing holder of claim 1, wherein said clothing holder, when in its use state, receives and stores a plurality of articles of clothing therein, and wherein, when said clothing holder stores a plurality of articles of clothing therein, said clothing holder is partially foldable over itself to a transport state, whereby a lower portion of said clothing holder is attachable to an upper portion of said backpack portion to allow said combination backpack and clothing holder to be carried with the plurality of articles of clothing stored in said clothing holder.

12. The combination backpack and clothing holder of claim 1, wherein graphics are established at said clothing holder to enhance the cognitive recognition by the user of the purpose of said clothing storage compartments of said clothing holder.

13. The combination backpack and clothing holder of claim 12, wherein said graphics comprise a cartoon character.

14. A combination backpack and clothing holder comprising:

a backpack portion defining at least one internal storage compartment and configured to be supported on a wearer's shoulders or back;

a clothing holder having the general shape of a body including a torso portion, a pair of arm portions extending outwardly from said torso portion, and a pair of leg portions extending outwardly from said torso portion;

wherein said torso portion of said clothing holder is attached at said backpack portion, wherein said clothing holder, while said torso portion is attached at said backpack portion, is configurable between a compact stored state, where said clothing holder is rolled or folded, and an unfurled use state in which said clothing holder is deployed and is configured to receive and store articles of clothing therein; and wherein said clothing holder, when in its use state, receives and stores a plurality of articles of clothing therein, and wherein, when said clothing holder stores a plurality of articles of clothing therein, said clothing holder is configurable to a transport state, where said clothing holder is partially foldable over itself whereby a lower portion of said clothing holder is attachable to an upper portion of said backpack portion to allow said combination backpack and clothing holder to be carried with the plurality of articles of clothing stored in said clothing holder.

15. The combination backpack and clothing holder of claim 14, wherein said clothing holder comprises a breathable fabric material to promote air-drying of clothing articles stored in said clothing storage compartments.

16. The combination backpack and clothing holder of claim 14, wherein said torso portion is generally in the shape of one chosen from (i) a human torso, (ii) a rocket body, (iii) an airplane body, (iv) a bird body, and (iv) an animal body.

17. The combination backpack and clothing holder of claim 14, wherein said clothing holder is attached at an outer surface of said backpack portion.

18. The combination backpack and clothing holder of claim 14, further comprising a second internal storage compartment, wherein said clothing holder is attached to said backpack portion inside of said second internal storage compartment.

19. The combination backpack and clothing holder of claim 18, further comprising a flap and a closure for selectively opening and closing said second internal storage compartment, said flap and said closure configured to fully enclose said clothing holder in said stored state inside of said second internal storage compartment.

20. The combination backpack and clothing holder of claim 14, wherein said clothing holder is releasably attachable at said backpack portion.

21. The combination backpack and clothing holder of claim 14, wherein said clothing holder is at least partially rolled when in said stored state.

22. The combination backpack and clothing holder of claim 14, further comprising at least one shoulder strap at said backpack portion.

* * * * *